US008191603B1

(12) United States Patent
Motosko

(10) Patent No.: US 8,191,603 B1
(45) Date of Patent: Jun. 5, 2012

(54) ACCORDION-TYPE TRANSPARENT SEGMENTED SHUTTER AND SHUTTER ASSEMBLY

(76) Inventor: Stephen J. Motosko, Sarasota, FL (US)

( * ) Notice: Subject to any disclaimer, the term of this patent is extended or adjusted under 35 U.S.C. 154(b) by 244 days.

(21) Appl. No.: 12/349,591

(22) Filed: Jan. 7, 2009

Related U.S. Application Data

(63) Continuation-in-part of application No. 12/263,918, filed on Nov. 3, 2008, now abandoned, and a continuation-in-part of application No. 12/215,513, filed on Jun. 27, 2008, now abandoned.

(51) Int. Cl.
*E06B 3/06* (2006.01)

(52) U.S. Cl. ..... 160/235; 160/229.1; 160/236

(58) Field of Classification Search ..... 160/235, 160/232, 236
See application file for complete search history.

(56) References Cited

U.S. PATENT DOCUMENTS

| | | | | | |
|---|---|---|---|---|---|
| 800,246 | A * | 9/1905 | Vance | 246/222 |
| 2,951,533 | A * | 9/1960 | Lucas et al. | 160/40 |
| 4,222,428 | A * | 9/1980 | Scherer | 160/231.1 |
| 4,345,635 | A | 8/1982 | Solomon | |
| 4,660,613 | A * | 4/1987 | Dagenais | 160/199 |
| 4,736,785 | A * | 4/1988 | Seuster | 160/264 |
| 4,922,987 | A * | 5/1990 | Marontate et al. | 160/183 |
| 5,099,904 | A * | 3/1992 | Susnar | 160/199 |
| 5,150,501 | A * | 9/1992 | Pasternak | 16/272 |
| 5,456,305 | A | 10/1995 | Snarli | |
| 5,507,335 | A * | 4/1996 | Yu | 160/235 |
| 5,682,643 | A * | 11/1997 | Duffy | 16/265 |
| 6,041,847 | A * | 3/2000 | Lai | 160/236 |
| 6,513,862 | B2 * | 2/2003 | Dodson et al. | 296/155 |
| 6,546,681 | B1 * | 4/2003 | Trundle | 52/202 |
| 2003/0047293 | A1 * | 3/2003 | Lee | 160/236 |

* cited by examiner

*Primary Examiner* — Blair M. Johnson
(74) *Attorney, Agent, or Firm* — Gifford, Krass, Sprinkle, Anderson & Citkowski, P.C.

(57) ABSTRACT

A shutter blade and blade assembly in an accordion shutter assembly used to protect a building opening from flying object damage caused by storm or hurricane. The blade assembly includes one or a plurality of preferably transparent or translucent plastic, preferably polycarbonate blades each having one molded edge defining a male hinge half and a slide-on metal female hinge half slidably engaged into the other edge of the shutter blade which is formed as a rail. The molded plastic male and slide-on metal female hinge halves have pivotally interacting features which matably engage with the corresponding edge of the next adjacent blade assembly to form the shutter assembly. Each blade assembly is preferably formed of a plurality of blades connectable together in an end-to-end arrangement and strengthened into a blade assembly by the preferably one-piece metal female hinge half.

14 Claims, 8 Drawing Sheets

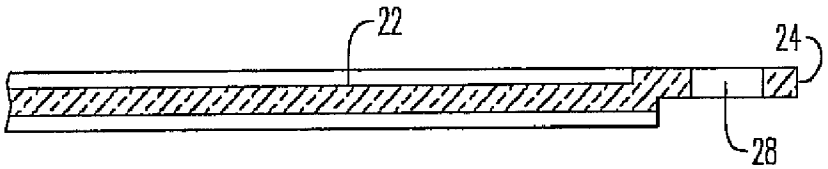
FIG. 8
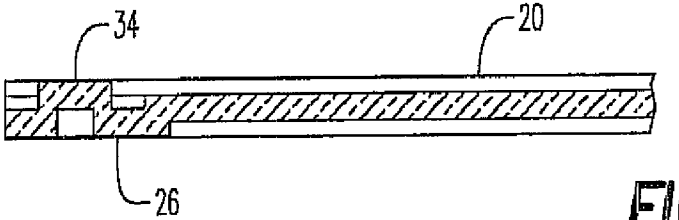
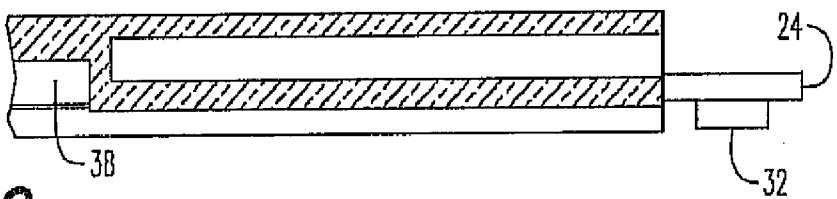
FIG. 9
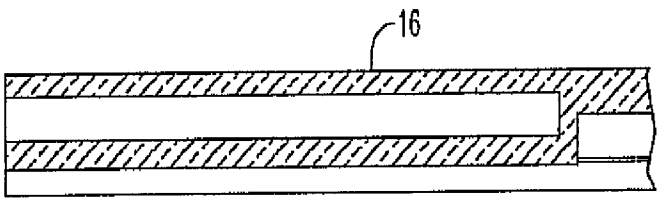

ACCORDION-TYPE TRANSPARENT SEGMENTED SHUTTER AND SHUTTER ASSEMBLY

CROSS-REFERENCE TO RELATED APPLICATIONS

This application is a continuation-in-part of U.S. application Ser. No. 12/263,918 filed Nov. 3, 2008 which is a continuation-in-part of U.S. application Ser. No. 12/215,513 filed Jun. 27, 2008.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to accordion-type hurricane shutters and assemblies thereof which, when deployed, protect windows and doors from flying object impact during storms and hurricanes, and more particularly to such a shutter, which is segmented for manufacturing ease, having transparency which allows light to enter into the building while still being fully protectively deployed over such building openings.

2. Description of Related Art

Accordion-type shutter assemblies and roll-up shutter assemblies have become extremely popular for protecting the windows and doors, and thus the interiors, of buildings during severe storms and hurricanes. Flying objects, which, when airborne, can exceed well over one hundred miles an hour during a hurricane, are easily able to penetrate through unprotected doors and windows leading to more severe building damage as a result thereof.

One drawback has developed with respect to the added protection afforded accordion shutters and roll-up shutters in that more occupants are choosing to remain in the building during a storm or hurricane rather than evacuating the building. However, when the accordion shutter assemblies are deployed over windows and doors, very little light is allowed to enter into the building and, as a result, should electric power be interrupted, the occupants may find themselves in virtual total darkness.

The following prior patents are intended to alleviate this shortcoming of accordion-type shutter assemblies by providing transparency for at least a portion of each of the shutters of the assembly.

U.S. Pat. No. 4,345,635 to Solomon discloses a rolling protective gate or door for store fronts, building entrances or the like in which vertical rods or links are completely eliminated and in which the gate is not made in open grille form, but which provides a high degree of visibility therethrough when the gate is in the lowered position.

Snarli teaches a rollable or foldable shutter for protecting window areas where all or parts of the shutter are transparent in U.S. Pat. No. 5,456,305.

A combination blade of extruded aluminum and transparent impact plastic such as polycarbonate to protect glass windows and doors is disclosed in U.S. Pat. No. 6,546,681 to Trundle.

The present invention also provides an improved transparent shutter for accordion-type shutter assemblies for protecting windows and doors during storms and hurricanes. However, the present disclosure further teaches such an improved transparency feature without the need for the use of overmolding, adhesives, or additional mechanical fasteners to effect strong positive engagement between the metallic hinge half edge and the transparent blade provided by this invention. Moreover, this invention will more than adequately meet current impact test requirements for such accordion shutter assemblies as set forth in municipal building codes.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a shutter blade and blade assembly in an accordion shutter assembly used to protect a building opening from flying object damage caused by storm or hurricane. The blade assembly includes a preferably transparent or translucent plastic, preferably polycarbonate shutter blade having one molded edge defining a male hinge half and a slide-on metal female hinge half slidably engaged into the other edge of the shutter blade which is formed as a rail. The molded plastic male and slide-on metal female hinge halves have pivotally interacting features which matably engage with the corresponding edge of the next adjacent blade assembly to form the shutter assembly. Each blade assembly is preferably formed of a plurality of blades connectable together in an end-to-end arrangement and strengthened into a blade assembly by the preferably one-piece metal female hinge half.

It is therefore an object of this invention to provide an improved accordion-type shutter assembly and blade assembly therefor which facilitates light entering into a building opening protected by this invention.

Yet another object of this invention is to provide an improved shutter blade for accordion-type shutter assemblies for windows and doors which is easily assemblable and affords the necessary strength and security by these assemblies without the need for adhesives or mechanical fasteners to effect adequate assembly strength.

It is still another object of this invention to provide an improved accordion-type shutter assembly wherein each shutter blade is made up of a plurality of shutter blades which are connectable together in end-to-end fashion by transversely oriented interlocking end structure on opposite ends thereof.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

FIG. 8 is a broken section view in the direction of arrows 8-8 in FIG. 5.

FIG. 9 is a broken section view in the direction of arrows 9-9 in FIG. 5.

Exemplary embodiments are illustrated in reference figures of the drawings. It is intended that the embodiments and figures disclosed herein are to be considered to be illustrative rather than limiting.

DETAILED DESCRIPTION OF THE INVENTION

Figure 1:
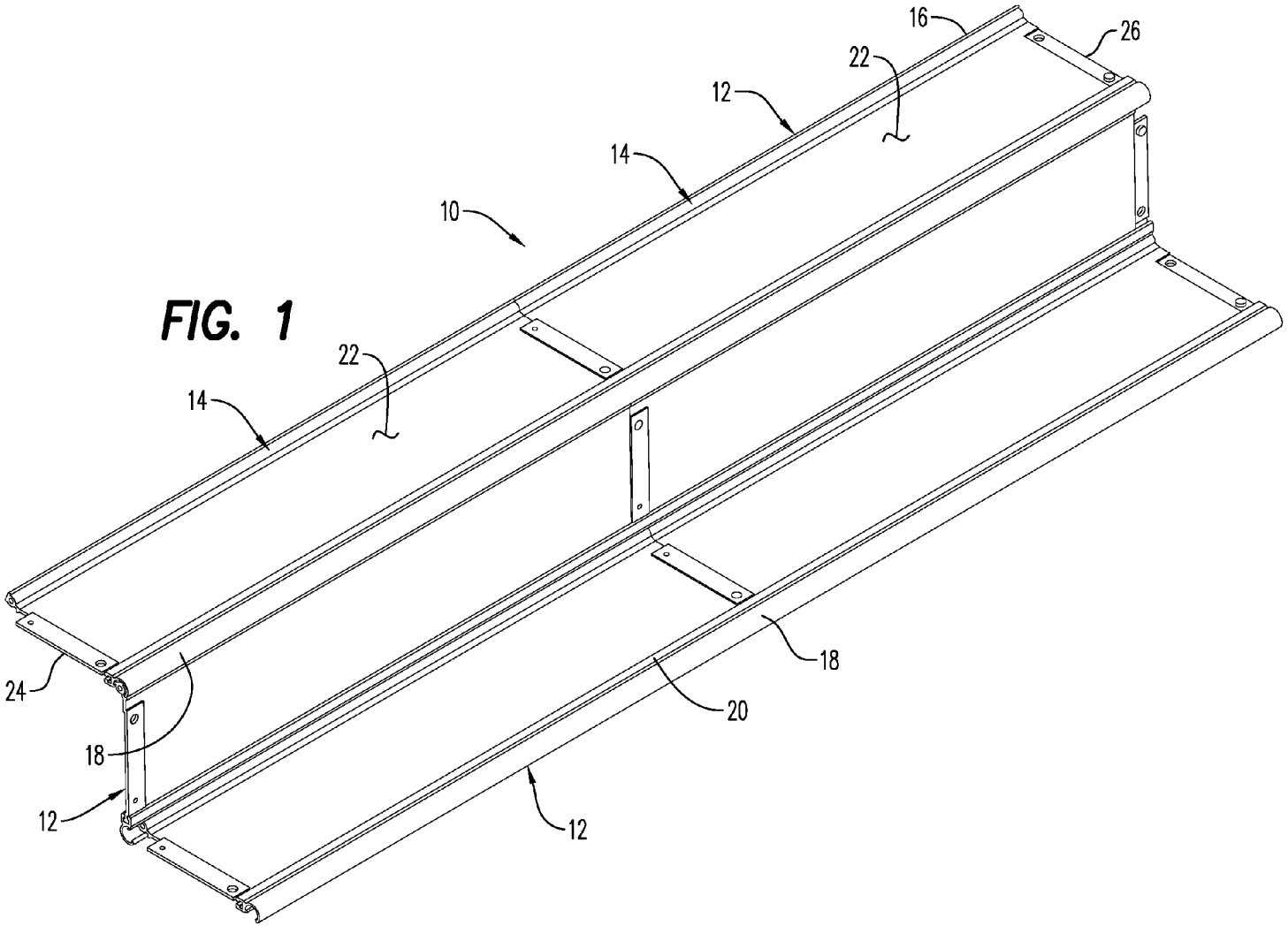
FIG. 1 is a perspective view of the preferred embodiment of a plurality of accordion shutter assemblies of this invention connected together in the open configuration.
Figure 2:
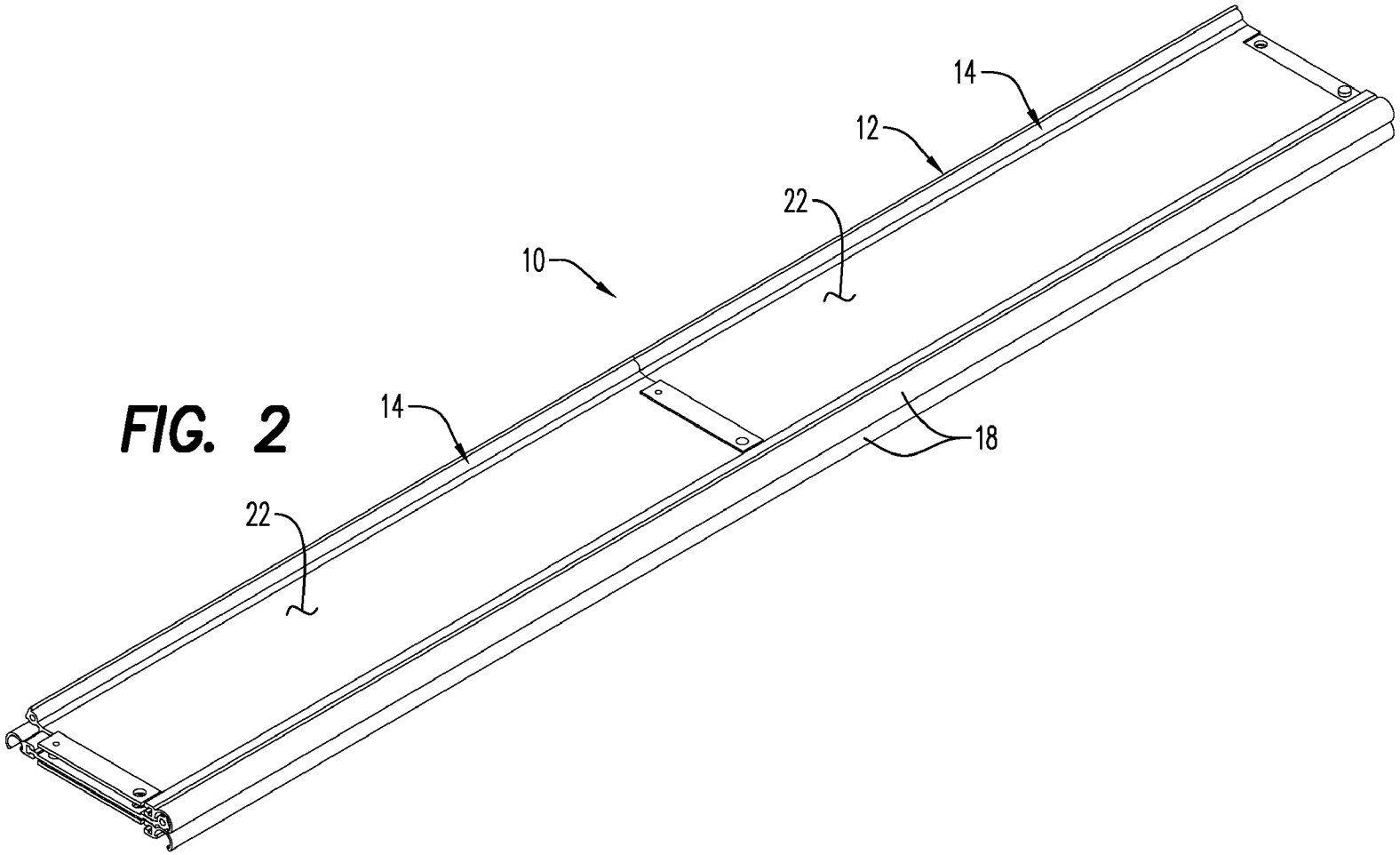
FIG. 2 is a perspective of one of the shutter assemblies of FIG. 1.
Figure 3A:
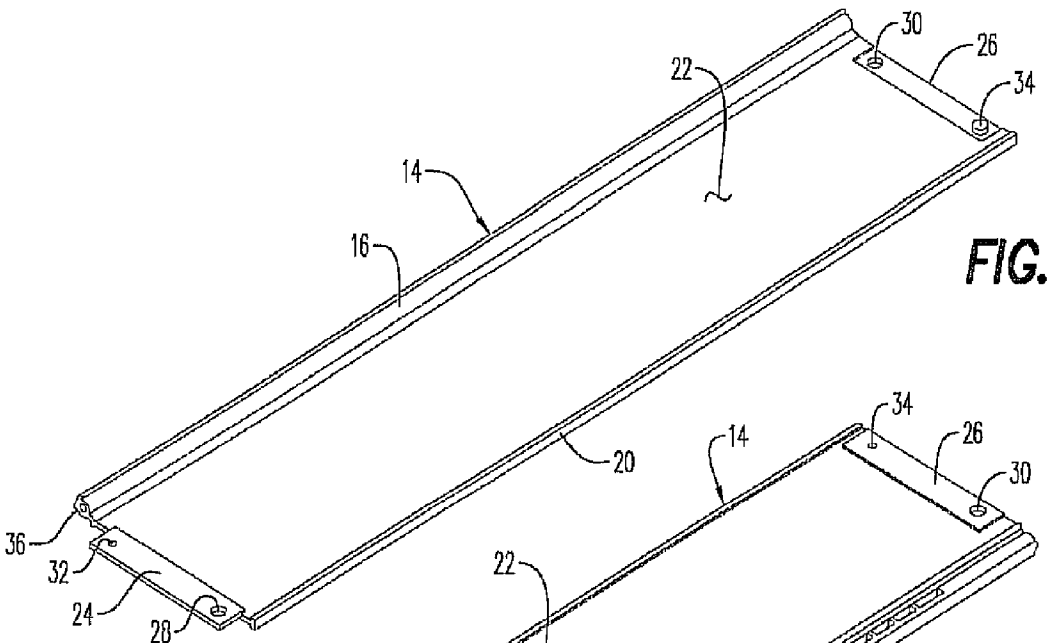
FIGS. 3A to 3D are perspective views of the blade assembly of FIGS. 1 and 2.
Figure 3B:
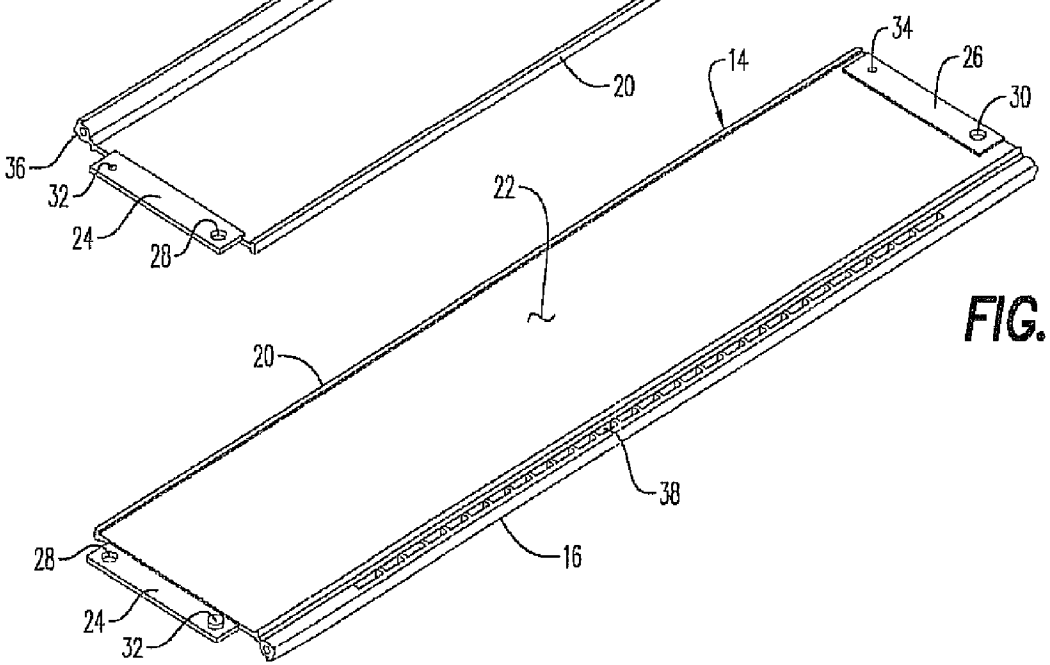
Figure 3C:
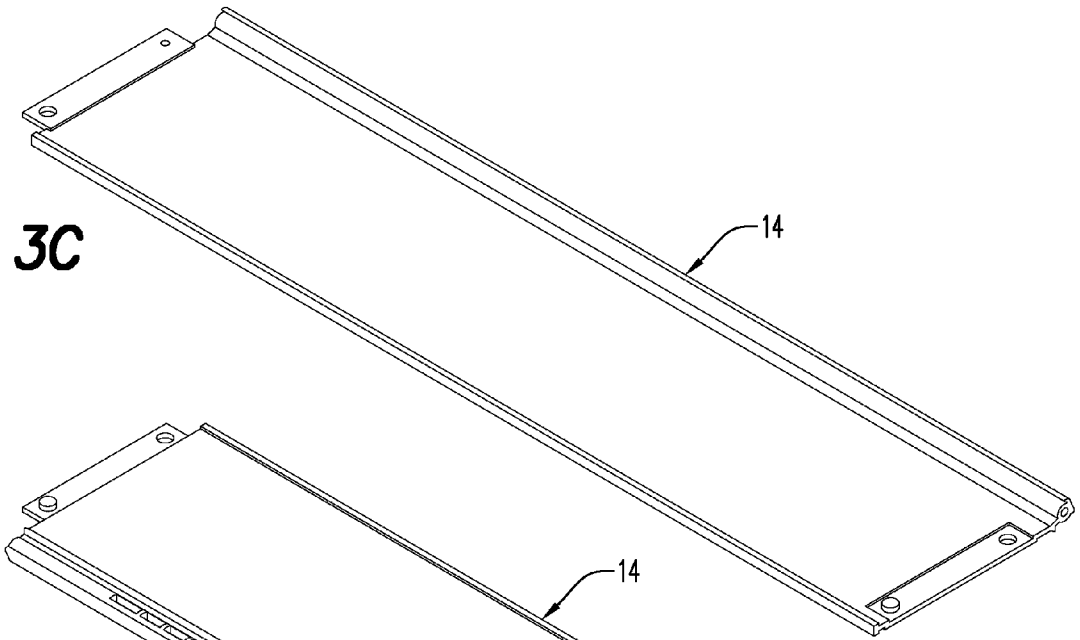
Figure 3D:
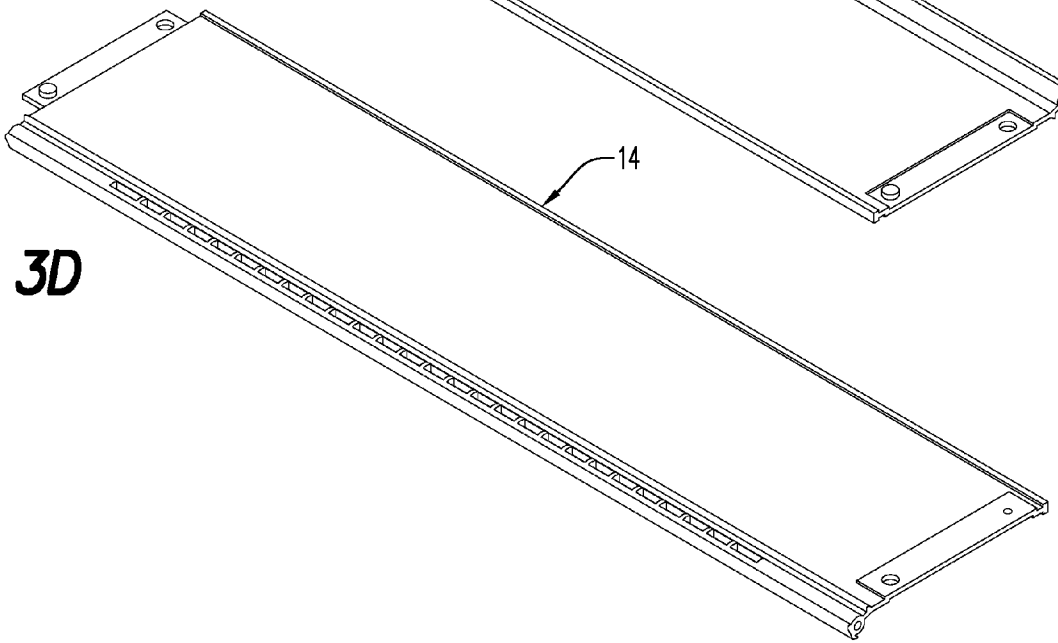

Referring now to the drawings, the invention is there shown generally at numeral 10 in a partially open, deployed orientation in FIG. 1 and in a folded closed position in FIG. 2. The shutter assembly 10 includes a plurality of blade assemblies 12, each of which includes a solid shutter blade panel 14 which is a mold formed of transparent, preferably polycarbonate plastic, and a metal, preferably aluminum extruded, metal female hinge half 18. Each of the shutter blades 14 is mold formed as a unit to define a central transparent or translucent flat viewing panel 22, a plastic male hinge half 16 molded along one side thereof, and an elongated T-shaped rail 20 molded along the other side of the blade 14. The elongated rail 20 includes a first portion 19 and a second portion 21. The first portion 19 extends outwardly from the blade 14 so as to be coplanar with the blade 14 and includes a proximate end connected to the other side of the blade 14. The second portion 21 extends generally normal from said distal end so as to provide the elongated rail 20 with the T-shape. The male hinge half 16 and the elongated rail 20 are formed as one piece with the blade 14 and composed of the same material as the blade 14. The male half hinges 16 include lightening holes 38 for economy and first hinge portion 36.

Figure 4A:
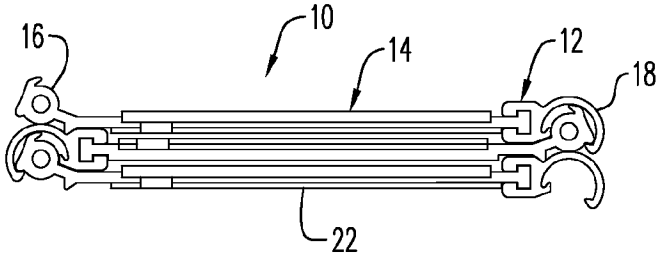
FIGS. 4A and 4B are end views of FIG. 1 in the closed and open positions of the shutter assembly 10.
Figure 4B:
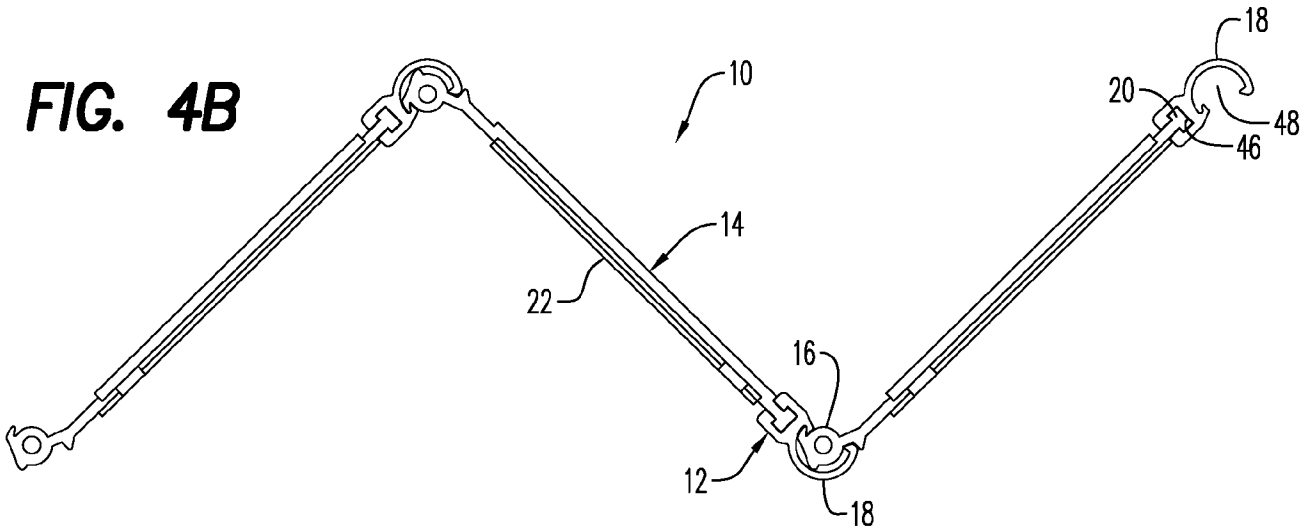
Figure 5:
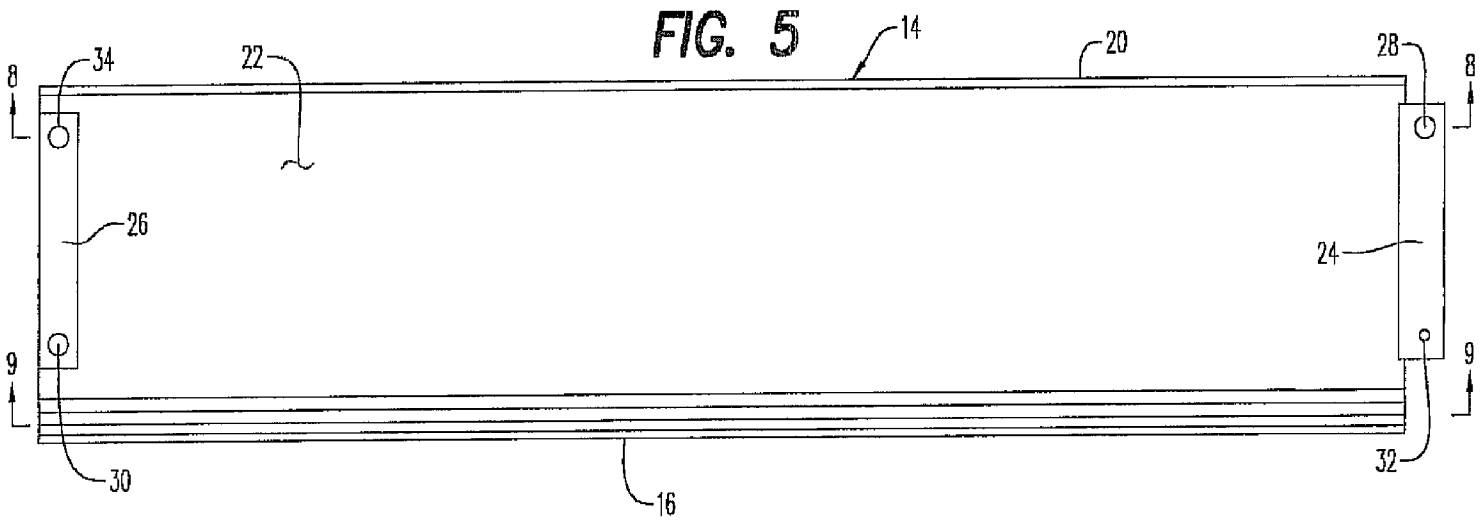
FIG. 5 is a plan view of the shutter blade of FIG. 1.
Figure 7:
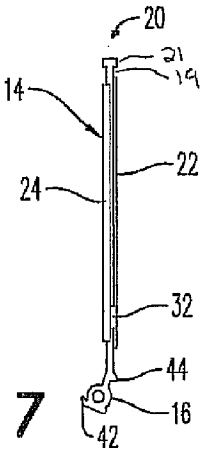
FIG. 7 is a right end view of FIG. 5.
Figure 6:
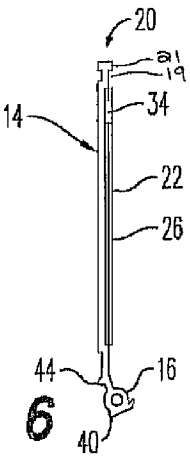
FIG. 6 is a left end view of FIG. 5.
Figure 10:
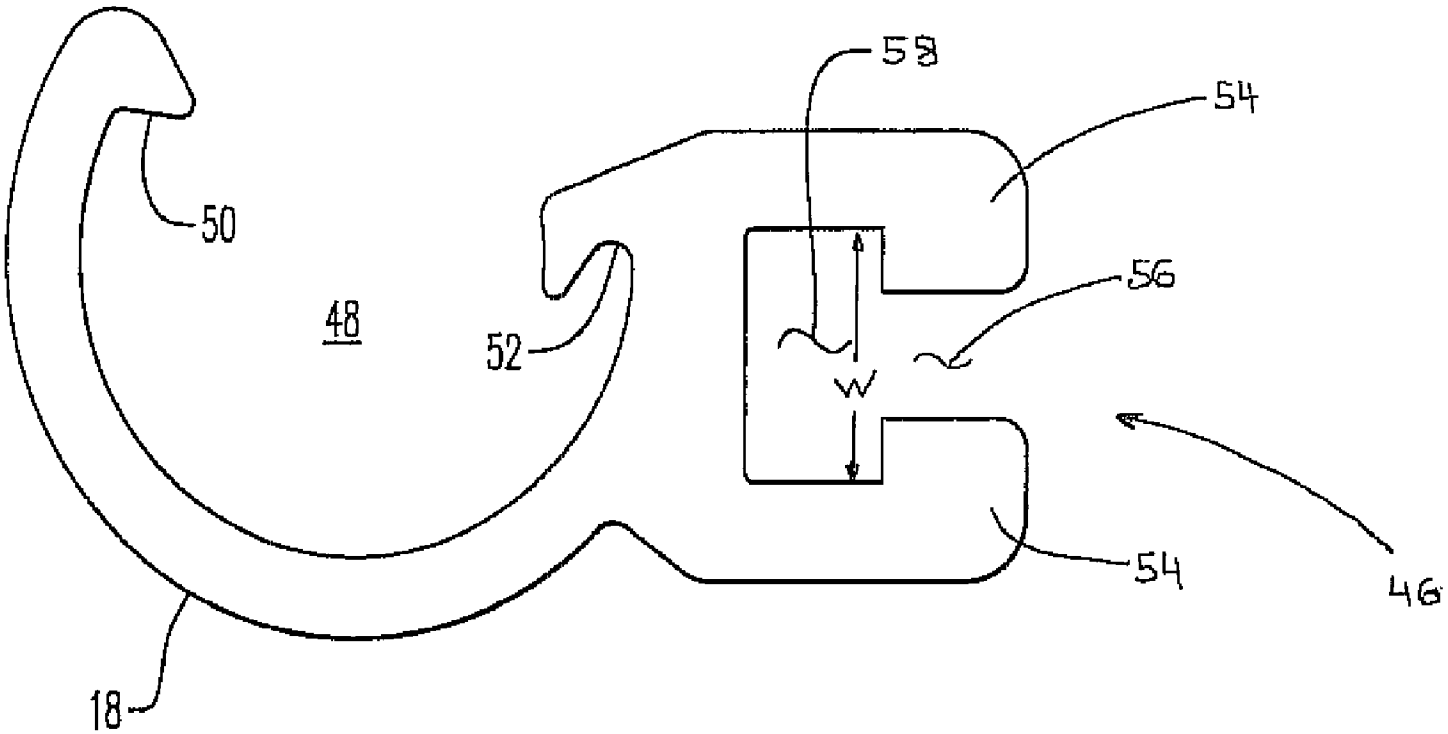
FIG. 10 is an end view of the interlocking metal male hinge half which extends along an edge of one shutter blade and slidably interlocks with the molded male hinge half of the next blade assembly.

The female hinge half 18 is formed as an aluminum extrusion and includes a hinge portion having a semi-circular cavity 48 as best seen in FIG. 10 sized to lengthwise slidably receive each mating molded male hinge half 16 formed as a unit with each of the end-to-end-connected molded blades 14. The female hinge half 18 also includes an inwardly extending channel or entrapping cavity 46 which lengthwise tightly slidably engages over the elongated rail 20 which has been mold formed as a single piece made of the same material as the blades 14. The female hinge half 18 includes a pair of fingers 54 which defines the entrapping cavity 46. The pair of fingers 54 are configured so as to provide the entrapping cavity 46 with a first section 56 and a second section 58 having a width in the W direction greater than the width of the first section 56. The first section 56 receives the first portion 19 of the elongated rail 20 and the second section 58 receives the second portion 21 of the elongated rail. The engagement of the elongated rail 20 with the cavity 46 is such that the female hinge half 18 does not pivot relative to the blade 14. The hinge halves 16 and 18, when engaged as shown in FIGS. 4A and 4B allow each of the blade assemblies 12 to freely pivotally move one to another between the closed position of the shutter assembly 10 in FIG. 4A and the opened position in FIG. 4B. Tabs 40, 42 and 44 formed onto the male hinge half 16 interengage with stops 50 and 52 of the female hinge half 18 to control the pivotal opening movement of the shutter assembly 10.

Referring now to FIGS. 3 and 5 to 9, each of the blades 14 is preferably mold formed in shorter sections so as to facilitate overall quality and straightness of each of the molded blades 14. Although typically a shutter blade as part of a shutter assembly has a length generally equal to the average height of the building opening, mold forming a plastic polycarbonate shutter blade of that length as a single molded unit while maintaining overall quality and transparent clarity is virtually impossible. Therefore, each of the blades 14 is mold formed in shorter lengths, typically in the range of about 18 inches long.

To interconnect each of these shorter shutter blades 14 together in end to end fashion, the blade 14 includes a first end tab 24 and a second end tab 26 which include a cavity 28/30 and a locking button 32/34 such that, which, when positioned end to end one to another, interlocking engagement of blades 14 together is accomplished by the locking button 32/34 being received within the cavities 38/30. As best seen in FIG. 8, the first end tab 24 and the second end tab 26 are offset from said blade 14 in opposite directions. The first end tab 24 extending beyond the male half hinge 16 and the elongated rail 20. The offset of the first end tab 24 and the second end tab 26 allows the adjacent blades 14 to connect such that the blades 14 extend coextensively as seen in FIGS. 1 and 2.

To provide an overall structural integrity for the plurality of blades 14 which are only pin-to-cavity connected as above described, the metal female hinge half 18 is extruded at the full length of each of the blade assemblies 12. Thus, the metal hinge half 18 spans all of the junctions of the end to end positioned and interlocked blades 14 to serve as a backbone along each margin between each of the segmented blades 14 after assembly.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. An accordion-type shutter assembly used to protect against impact damage, said shutter assembly comprising:

a plurality of elongated transparent solid blade panels each panel having a first side and an opposite second side, said first side includes a first hinge half having a first hinge portion extending a length of said blade panel, said second side having an elongated T-shaped rail extending outwardly from said second side, said rail extending a length of said blade panel, said first hinge half and said elongated rail being formed as one piece with said blade panel and composed of the same material as said blade panel; and a second hinge half having an inwardly extending channel on one side and a second hinge portion at an opposite side, said elongated rail engages within said channel to secure said second hinge half to said blade panel such that said second hinge half does not pivot relative to said blade panel, said second hinge portion engages with said first hinge portion of an adjacent blade panel to form a pivotal hinge for opening and closing said shutter assembly, said blade panel includes a first end and a second end, said first end includes a first tab and said second end includes a second tab, and wherein one of said first end and said second end includes a locking button and the other of said first end and said second end includes locking cavity, and wherein said first end engages with a second end of an adjacent blade panel in an end to end fashion such that said locking button is received within said locking cavity, and wherein said first tab and said second tab are offset from said blade panel such that upon engagement of said first tab with said second tab of an adjacent blade panel, said blade panels extend coextensively.

2. The shutter assembly of claim 1, wherein said second hinge half extends along said length of said blade panel.

3. The shutter assembly of claim 1, wherein said second hinge half is formed of a metallic material.

4. The shutter assembly of claim 1, wherein said elongated rail has a thickness greater than a thickness of said blade panel.

5. The shutter assembly of claim 1, wherein said blade panel is molded from a polycarbonate.

6. The shutter assembly of claim 1, wherein said first hinge portion is a male hinge half and said second hinge portion is a female hinge half.

7. The shutter assembly of claim 6, wherein said second hinge portion defines a cavity for receiving said first hinge portion.

8. The shutter assembly of claim 1, wherein said first tab is offset in a first direction and said second tab is offset in an opposite second direction.

9. The shutter assembly of claim 1, wherein said first tab extends beyond said first hinge half and said elongated rail.

10. An accordion-type shutter assembly used to protect against impact damage, said shutter assembly comprising:

a plurality of elongated transparent blade panels each panel having a first end, a second end, and a pair of sides traversing said first end and said second end, one of said first end and said second end includes a locking button and an other of said first end and said second end includes locking cavity, and wherein said first end engages with a second end of an adjacent blade panel in an end to end fashion such that said locking button is received within said locking cavity; and a hinge operatively connected between adjacent blade panels to form a pivotal hinge for opening and closing said shutter assembly said first end includes a first tab and said second end includes a second tab, and wherein said first tab is offset from said blade panel in a first direction and said second tab is offset from said blade panel in an opposite second direction such that upon engagement of said first tab and said second tab of an adjacent blade panel, said blade panels extend coextensively.

11. The shutter assembly of claim 10, wherein said first tab extends beyond said first hinge half and said elongated rail.

12. The shutter assembly of claim 10, wherein said first end and said second end each include a locking button and a locking cavity to lockably engage said adjacent blade panels in an end to end fashion, said locking button of said first end corresponds to said locking cavity of said second end, and said locking cavity of said first end corresponds to said locking button of said second end.

13. The shutter assembly of claim 1, wherein said elongated rail includes a first portion and a second portion, said first portion having a proximate end and an opposite distal end, said proximate end connected to said second side of said blade panel, and said first portion extending outwardly from said second side so as to be coplanar with said blade panel, and wherein said second portion extends generally normal from said distal end providing said elongated rail with said generally T-shape.

14. The shutter assembly of claim 13, wherein said second hinge half includes a pair of opposing fingers which defines said inwardly extending channel, and wherein said channel includes a first section and a second section having a width greater than said first section, said first section receiving said first portion and said second section receiving said second portion.

* * * * *